US010593180B2

(12) United States Patent
Hopfe et al.

(10) Patent No.: US 10,593,180 B2
(45) Date of Patent: Mar. 17, 2020

(54) HEATABLE SMOKE ALARM

(71) Applicant: DIEHL AVIATION GILCHING GMBH, Gilching (DE)

(72) Inventors: Karl Albrecht Hopfe, Dresden (DE); Jan Boris Philipp, Munich (DE)

(73) Assignee: Diehl Aviation Gilching GmbH, Gilching (DE)

( * ) Notice: Subject to any disclaimer, the term of this patent is extended or adjusted under 35 U.S.C. 154(b) by 53 days.

(21) Appl. No.: 15/223,249

(22) Filed: Jul. 29, 2016

(65) Prior Publication Data

US 2017/0032643 A1 Feb. 2, 2017

(30) Foreign Application Priority Data

Jul. 30, 2015 (DE) ..... 10 2015 009 938

(51) Int. Cl.
*G08B 17/11* (2006.01)
*G08B 17/107* (2006.01)
*H05B 3/00* (2006.01)

(52) U.S. Cl.
CPC ..... *G08B 17/11* (2013.01); *G08B 17/107* (2013.01); *H05B 3/008* (2013.01); *H05B 3/009* (2013.01); *H05B 2203/032* (2013.01)

(58) Field of Classification Search
CPC .. H05B 3/009; H05B 3/008; H05B 2203/032; G08B 17/107
See application file for complete search history.

(56) References Cited

U.S. PATENT DOCUMENTS 6,218,950 B1 4/2001 Politze et al.
7,777,634 B2 8/2010 Kaelin et al.
9,036,150 B2 5/2015 Wedler et al.
2008/0246623 A1 10/2008 Nagashima
2011/0181870 A1* 7/2011 Penney ..... F21V 9/30 356/72
2011/0221889 A1* 9/2011 Knox ..... G01N 21/538 348/135
2011/0304268 A1* 12/2011 Bertram ..... F21V 3/00 315/46
2013/0135607 A1* 5/2013 Wedler ..... G01N 21/53 356/51
2015/0170490 A1* 6/2015 Shaw ..... G01N 21/64 250/459.1

FOREIGN PATENT DOCUMENTS

DE 102004032294 A1 2/2006
DE 102009010180 A1 10/2010
DE 102011119431 A1 5/2013
WO 2006037804 A1 4/2006
WO WO 2016009449 * 1/2016 ..... H01L 33/00

OTHER PUBLICATIONS

English Translation of DE 102004032294.*

* cited by examiner

*Primary Examiner* — Patrick N Edouard
*Assistant Examiner* — Eboni N Giles
(74) *Attorney, Agent, or Firm* — Laurence A. Greenberg; Werner H. Stemer; Ralph E. Locher

(57) ABSTRACT

A smoke alarm has a housing with a heating device for heating walls of the housing to a temperature above the dew point. The heating device has at least one heating light emitting diode (LED). The heating LED has an opening angle for the emission of light, which opening angle leads to an irradiated area of the housing.

15 Claims, 1 Drawing Sheet

HEATABLE SMOKE ALARM

CROSS-REFERENCE TO RELATED APPLICATION

This application claims the priority, under 35 U.S.C. § 119, of German application DE 10 2015 009 938.8, filed Jul. 30, 2015; the prior application is herewith incorporated by reference in its entirety.

BACKGROUND OF THE INVENTION

Field of the Invention

The invention relates to a smoke alarm. Such a smoke alarm is known from published, non-prosecuted German patent application DE 10 2004 032 294 A1.

In the known smoke alarm, an area of a measuring chamber is provided with a heating film operated as an electrical resistance heater. Heating of the measuring chamber counteracts dew formation which impairs the functionality of the smoke alarm. The production of the known smoke alarm is complex. The provision of the heating film disadvantageously restricts an entry area for gas exchange with the surroundings. That leads to delayed response behavior upon evolution of smoke.

Published, non-prosecuted German patent application DE 10 2011 119 431 A1, corresponding to U.S. Pat. No. 9,036,150, discloses a scattered radiation fire alarm equipped with a plurality of resistance heaters at a plurality of locations of the housing. Fitting a plurality of resistance heaters in the housing is complex.

SUMMARY OF THE INVENTION

It is an object of the invention to eliminate the disadvantages according to the prior art. In particular, the intention is to specify a smoke alarm containing a simple heating device which can be produced cost-effectively.

In order to achieve the object it is proposed that the heating device contains at least one heating LED.

A heating LED is a light-emitting diode. The heating LED emits light, e.g. in the form of a luminous cone around an optical axis. For adapting the luminous cone, the heating LED can comprise an LED housing having a light exit opening and/or a diaphragm. The angle between optical axis and cone surface is referred to hereinafter as opening angle.

The heating LED heats the walls of the housing by the emitted light. Besides the emission of light, waste heat is also generated by the operation of the heating LED. The waste heat heats the region in which the heating LED is arranged. The heating LED can be operated continuously or preferably in a pulsed fashion.

The smoke alarm is a scattered radiation fire alarm containing at least one radiation source and at least one detector for detecting a scattered radiation and/or for detecting a radiation generated by the heating LED. Radiation source and detector respectively have a first and second optical axis. The radiation source emits light in the form of a radiation cone whose axis of symmetry forms a first optical axis. Analogously, the detector detects radiation from a conical volume whose axis of symmetry forms a second optical axis. A scattered radiation in the detectable conical volume is referred to as detectable scattered radiation. In this case, radiation source and detector are arranged such that the detector can detect the scattered radiation brought about by smoke particles situated in the housing. First and second optical axes preferably intersect.

The scattered radiation arises as a result of the fact that the radiation impinges on smoke particles within a radiation cone and is scattered at the particles. The intersection volume between the radiation cone of the incident radiation and the conical volume of the detectable scattered radiation forms a scattering volume.

In particular, the arrangement is chosen such that a point of intersection between a first optical axis of the radiation source and a second optical axis of the detector is situated within the luminous cone of the heating device. The radiation source can be operated continuously or preferably in a pulsed fashion. In this embodiment, the perforations are configured as a light trap in order that no light from outside penetrates and corrupts the optical measurement.

The housing of the smoke alarm typically has a cylindrical shape delimited by the walls. Within the meaning of the invention, the term "wall" is understood to be a base, a top surface and/or side walls of the housing. The inner surfaces of the housing are typically embodied in a dark color, in particular black. The housing has perforations which enable gas exchange with the surroundings. The smoke alarm can be e.g. an ionization or optical smoke alarm. In the case of an optical smoke alarm, the perforations are configured as a light trap.

The heating device can comprise one or more heating LEDs. Preferably, the heating device has a power ≥0.2 W. The power is typically between 0.2 W and 3 W, in particular between 0.5 W and 1.5 W, in particular approximately 1 W.

Preferably, the at least one heating LED is a white, blue LED or IR LED. Heating LEDs having these wavelengths typically have a higher power. Expediently, the heating device has an efficiency of at least 25%, preferably at least 35%, preferably approximately 50%. The efficiency is understood to mean the proportion of the radiation power relative to the electrical input power. In principle, however, heating LEDs having a higher efficiency are also possible for the application according to the invention.

Expediently, the heating device is mounted on a housing top side facing the housing interior and is suitable for emitting radiation in the direction of a housing underside opposite the housing top side. The light impinges on the housing underside, where it is partly absorbed and emitted as infrared radiation. The emitted light of the heating LED can also contain infrared portions, whereby the walls of the housing are heated directly. The waste heat of the heating LED additionally heats the housing top side. The top side and the underside of the housing are thus heated simultaneously.

Preferably, the opening angle of the at least one heating LED is chosen such that at least 90% of the housing underside is illuminated by the heating device. An opening angle of the heating device that corresponds to the area of the housing underside contributes in particular to a homogeneous temperature distribution within the smoke alarm. Undesirable dew formation is thus avoided.

In one expedient configuration, the smoke alarm contains at least two first radiation sources having a first wavelength and a radiation source having a second wavelength, which is greater than the first wavelength. The detector is a sensor which is sensitive to the first and second wavelengths. The first radiation sources have first optical axes, the second radiation source has a third optical axis and the sensor has a second optical axis. The first radiation sources, the second radiation source and the sensor are arranged such that their optical axes are directed at a common centre. The first radiation sources, the second radiation source and the sensor are arranged such that they lie on the end points of a base face of an imaginary pyramid, and are furthermore aligned such that the center forms the vertex of the pyramid. The sensor is configured for detecting the scattered radiation and/or for detecting the radiation generated by the heating LED. In particular, it is suitable for detecting scattered radiation and also radiation generated by the heating LED with sufficient sensitivity.

The first wavelength is advantageously between 460 nm and 540 nm, preferably approximately 525 nm. The first wavelength is thus in the range of visible light, preferably in the green spectral range. By contrast, the second wavelength is preferably in the infrared spectral range, in particular between 890 nm and 990 nm, preferably approximately 940 nm. The first and second radiation sources are preferably likewise LEDs. Such a scattered radiation fire alarm is disclosed for example in German patent DE 10 2011 119 431 B4.

Expediently, the heating device is arranged in the same plane as the first radiation sources and the second radiation source. This ensures that the scattering volume is heated sufficiently and no condensation water drops are situated in the scattering volume. Expediently, the first radiation sources, the second radiation source and the sensor are arranged on an imaginary circle whose center forms the heating device. As a result of the symmetrical arrangement, the scattering volume is optimally heated.

The heating device is preferably switched off for a duration within which the at least one radiation source emits a light pulse for detecting the scattered radiation by the detector. The heating device and the radiation sources can be operated alternately in a pulsed fashion. The duration for which the heating device is switched off can be less than 50 ms, in particular less than 10 ms. Switching off the heating device during the measurement of the scattered radiation serves to avoid corruption of the measurement by possible scattering of the light emitted by the heating LED.

One advantageous configuration provides for the function of the heating LED also to be monitored by the sensor. For this purpose, during a switch-on clock cycle of the heating LED, the radiation emitted thereby can be detected by the sensor and evaluated. That is to say that the signals detected by the sensor can be evaluated cyclically alternately by two different algorithms. A first algorithm during a switch-on clock cycle of the heating LED serves for testing and monitoring the functionality of the heating LED. A second algorithm during a switch-on clock cycle of the radiation sources serves for measuring the scattered radiation.

Expediently, perforations of the housing are arranged on at least one side face. The perforations serve for gas exchange with the surroundings. As a result, smoke-laden ambient air can pass into the housing. Expediently, the perforations are arranged on all side faces of the housing or on a plurality of sides of the cylindrical housing, such that the smoke alarm function is not direction-dependent. Particularly in the case of a scattered radiation fire alarm, the perforations are configured as a light trap.

The smoke alarm expediently contains a control device for controlling the heating device. The heating power or the pulse duration and/or the pulse instant can thus be predefined.

Preferably, the smoke alarm contains a temperature regulating device and a temperature sensor for measuring the temperature within the smoke alarm, wherein the temperature regulating device outputs a control signal for driving the heating device. The temperature regulating device serves in particular for switching off the heating device at temperatures above a set point temperature and for switching on below a set point temperature. The heating device can thus be switched off at temperatures at which dew formation in the smoke alarm need not be feared, and hence consumes less power. The set point temperature is in particular at least 15° C., in particular at least 20° C.

Expediently, the smoke alarm furthermore contains a moisture regulating device and a moisture sensor for measuring the moisture within the smoke alarm. The moisture regulating device outputs a control signal for driving the heating device. The moisture regulating device serves in particular for switching on the heating device at moisture values above a pre defined moisture and for switching off the smoke alarm below a predefined moisture.

The energy requirement of the heating device can be reduced by the temperature and/or moisture regulation.

Other features which are considered as characteristic for the invention are set forth in the appended claims.

Although the invention is illustrated and described herein as embodied in a heatable smoke alarm, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
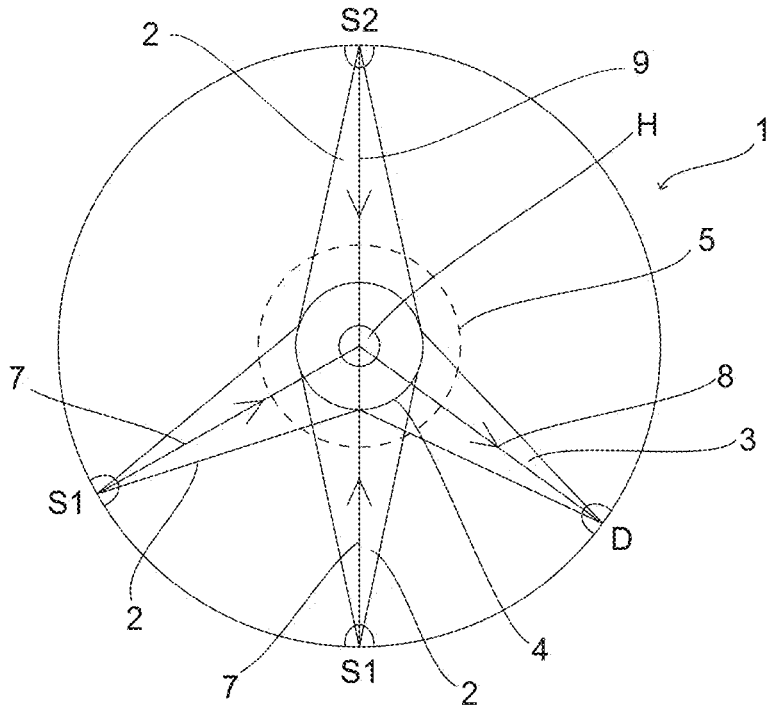
FIG. 1 is a schematic illustration of a three-channel scattered radiation fire alarm containing an LED as a heating device according to the invention.

Referring now to the figures of the drawings in detail and first, particularly to FIG. 1 thereof, there is shown a smoke alarm 1 containing two first radiation sources S1, a second radiation source S2 and a detector D. In this example, the first radiation sources S1 and also the second radiation source S2 and the detector D are arranged on a circle. The first radiation source S1 has a first optical axis 7, the second radiation source S2 has a third optical axis 9, and the detector D has a second optical axis 8. The optical axes 7, 8, 9 meet at the center of the circle. The optical axes 7, 9 form the center of the cone of the incident radiation 2 and the optical axis 8 forms the center of the cone of the scattered radiation 3 to be detectable.

The scattering volume includes the point of intersection of the optical axes 7, 8, 9 and is the intersection volume of the cone of the incident radiation 2 and the detectable scattered radiation 3. A heating device H is furthermore arranged at the center of the circle. In this case, the heating device H lies on a different plane from the scattering volume 4. This ensures that the heating device H does not restrict the function of the smoke alarm 1.

The heating device H contains a heating LED suitable for emitting light and for emitting power loss in the form of heat. The heating LED has an opening angle for the emission of light, which opening angle leads to an irradiated area of the housing, the heating area 5. Expediently, in this embodiment, the two first radiation sources S1, the second radiation source S2 and the detector D and also the heating device H are arranged in one plane, in particular on a common circuit board. The arrangement of all the optical components S1, S2, D, H on a circuit board has the advantage that the circuit board can be populated during production in the same work step and can then be inserted as a whole into the housing of the smoke alarm.

Figure 2:
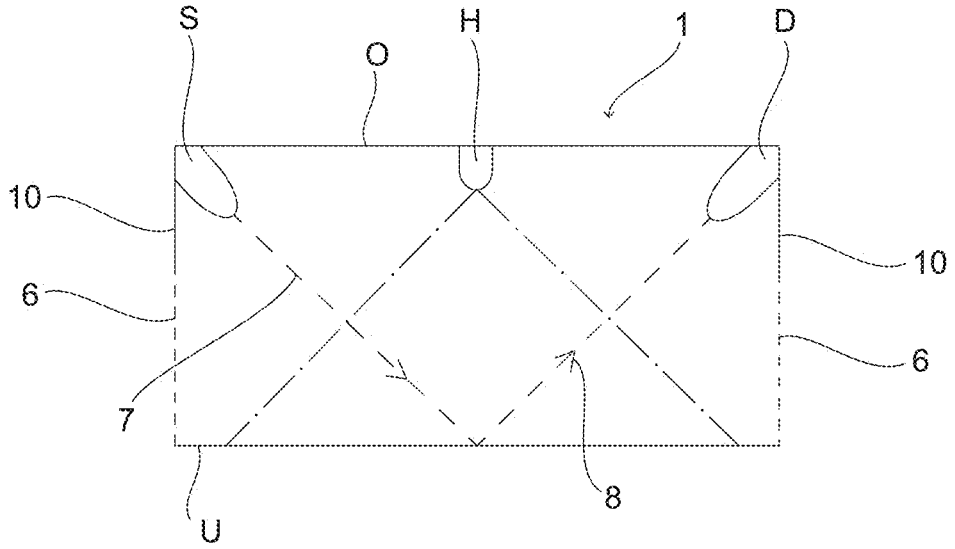
FIG. 2 is a diagrammatic, cross-sectional depiction of a scattered radiation fire alarm.

FIG. 2 shows a smoke alarm 1 containing a radiation source S and a detector D. The radiation source S and the smoke alarm 1 are arranged at an outer boundary of the housing top side O such that the first optical axis 7 of the radiation source S and the second optical axis 8 of the detector D meet at a point at the housing underside U opposite the housing top side O. A scattering volume 4 (not illustrated here) encompasses the point of intersection of the optical axes 7 and 8. The heating device H is likewise arranged at a housing top side O. Expediently, the radiation source S, the detector D and the heating device H are arranged on a circuit board. The heating LED is suitable for emitting radiation in a cone-shaped fashion within an opening angle, such that at least one part of the housing underside U is illuminated by the heating radiation. The area of intersection of a radiation cone of the heating LED and the housing underside U is identified as heating area 5. The point of intersection of the optical axes 7 and 8 lies in the heating area 5.

The side faces 10 of the housing have perforations 6. The perforations 6 serve for gas exchange with the surroundings. Smoke-containing gas can pass into the smoke alarm 1, such that smoke particles can be situated in the scattering volume 4. The perforations 6 are configured as a light trap.

For regulating the heating device H, sensors (not illustrated) for temperature and/or moisture and a temperature and/or moisture regulating device can additionally be present, which serve to switch on the heating device H as soon as temperature and/or air humidity afford(s) the possibility of dew formation in the smoke alarm 1.

Furthermore, a control device can be present, which switches off the heating device H for a short time duration. While the heating device H is switched off, a light pulse is emitted by the first radiation sources S1 and/or the second radiation source S2, which light pulse can be scattered at smoke particles in the scattering volume 4. The detectable scattered radiation 3 is detected by the detector D. As soon as the measurement process has ended, the heating device H can be switched on again. This duration of the measurement process is in the milliseconds range, in particular 0.5 to 10 ms. The alternately pulsed operation of heating device and radiation sources prevents corruption of the measurement.

Furthermore, the detector D can also be used to monitor the function of the heating device H. For this purpose, further scattered radiation generated by light emitted by the heating device H is detected by the detector D. As a result, it is possible to monitor the functioning of the heating device H.

The following is a summary list of reference numerals and the corresponding structure used in the above description of the invention:

1 Smoke alarm
2 Incident radiation
3 Detectable scattered radiation
4 Scattering volume
5 Heating area
6 Perforation
7 First optical axis
8 Second optical axis
9 Third optical axis
10 Side face
D Detector
H Heating device
Housing top side
S Radiation source
S1 First radiation source
S2 Second radiation source
U Housing underside

The invention claimed is:

1. A smoke alarm being a scattered radiation fire alarm, comprising:

a housing having walls;

a heating device having at least one heating light emitting diode (LED) heating said walls of said housing to a temperature above a dew point by emitted light, light emitted from the at least one heating LED not being used to detect smoke;

at least one radiation source;

at least one detector for detecting at least one of scattered radiation or radiation generated by said at least one heating LED; and the smoke alarm configured to switch off said heating device for a duration within which said at least one radiation source emits a light pulse for detecting the scattered radiation, wherein said heating device and said radiation source do not emit light simultaneously.

2. The smoke alarm according to claim 1, wherein said heating device containing said at least one heating LED has a power of ≥0.2 W.

3. The smoke alarm according to claim 1, wherein said at least one heating LED is a white LED, a blue LED or an infrared LED.

4. The smoke alarm according to claim 1, wherein an efficiency of said heating device is at least 25%.

5. The smoke alarm according to claim 1, wherein said heating device is mounted on a housing top side facing a housing interior and is suitable for emitting radiation in a direction of a housing underside opposite said housing top side.

6. The smoke alarm according to claim 5, wherein an opening angle of said heating device is chosen such that at least 90% of said housing underside is illuminated by said heating device.

7. The smoke alarm according to claim 1, wherein said radiation source is one of at least two first radiation sources having a first wavelength;

further comprising a second radiation source having a second wavelength, which is greater than the first wavelength;

wherein said detector is a sensor which is sensitive to the first and second wavelengths;

wherein said first radiation sources have first optical axes;

said second radiation source has a third optical axis;

said detector has a second optical axis, and said first radiation sources, said second radiation source and said detector are disposed such that their optical axes are directed at a common center; and wherein said first radiation sources, said second radiation source and said detector are disposed such that they lie on corner points of a base face of an imaginary pyramid, and are furthermore aligned such that a center forms a vertex of the imaginary pyramid.

8. The smoke alarm according to claim 7, wherein said heating device is disposed a same plane as said first radiation sources and said second radiation source.

9. The smoke alarm according to claim 8, wherein said first radiation sources, said second radiation source and said detector are disposed on an imaginary circle and said heating device is disposed at a center of the imaginary circle.

10. The smoke alarm according to claim 1, wherein said housing has perforations formed therein and formed on at least one side face of said housing.

11. The smoke alarm according to claim 1, further comprising a control device for controlling said heating device.

12. The smoke alarm according to claim 1, further comprising:

a temperature sensor for measuring a temperature within the smoke alarm; and a temperature regulating device outputting a control signal for driving said heating device.

13. The smoke alarm according to claim 1, further comprising:

a moisture sensor for measuring moisture within the smoke alarm; and a moisture regulating device for outputting a control signal for driving said heating device.

14. The smoke alarm according to claim 1, wherein an efficiency of said heating device is at least 35%.

15. A smoke alarm being a scattered radiation fire alarm, comprising:

a housing having walls;

a heating device having at least one heating light emitting diode (LED) heating said walls of said housing to a temperature above a dew point by emitted light, light emitted from the at least one heating LED not being used to detect smoke;

at least one radiation source;

at least one detector for detecting at least one of scattered radiation or radiation generated by said at least one heating LED;

a first optical axis of the radiation source and a second optical axis of the at least one detector being situated within a luminous cone of said at least one heating LED; and the smoke alarm configured to switch off said heating device for a duration within which said at least one radiation source emits a light pulse for detecting the scattered radiation, wherein said heating device and said radiation source do not emit light simultaneously.

* * * * *